US010533438B2

(12) United States Patent
Hecker et al.

(10) Patent No.: US 10,533,438 B2
(45) Date of Patent: Jan. 14, 2020

(54) INFLOW CONTOUR FOR A SINGLE-SHAFT ARRANGEMENT

(71) Applicant: Siemens Aktiengesellschaft, Munich (DE)

(72) Inventors: Simon Hecker, Recklinghausen (DE); Martin Kuhn, Neuss (DE); Christoph Kästner, Oberhausen (DE); Alexander Todorov, Mülheim (DE)

(73) Assignee: Siemens Aktiengesellschaft, Munich (DE)

( * ) Notice: Subject to any disclaimer, the term of this patent is extended or adjusted under 35 U.S.C. 154(b) by 175 days.

(21) Appl. No.: 15/526,044

(22) PCT Filed: Nov. 11, 2015

(86) PCT No.: PCT/EP2015/076312

§ 371 (c)(1),
(2) Date: May 11, 2017

(87) PCT Pub. No.: WO2016/078984

PCT Pub. Date: May 26, 2016

(65) Prior Publication Data

US 2017/0314404 A1 Nov. 2, 2017

(30) Foreign Application Priority Data

Nov. 20, 2014 (EP) ..... 14194077

(51) Int. Cl.
*F01D 9/02* (2006.01)
*F01D 5/02* (2006.01)

(52) U.S. Cl.
CPC ..... *F01D 9/02* (2013.01); *F01D 5/02* (2013.01); *F05D 2220/31* (2013.01)

(58) Field of Classification Search
CPC . F01D 9/02; F01D 9/026; F01D 17/18; F01D 5/02; F05D 2270/17; F05D 2220/31
(Continued)

(56) References Cited

U.S. PATENT DOCUMENTS 3,982,849 A * 9/1976 Bernasconi ..... F01D 3/02 415/101
4,141,672 A * 2/1979 Wieland ..... F01D 1/023 415/1

(Continued)

FOREIGN PATENT DOCUMENTS

CH 707747 A2 9/2014
EP 1170464 A2 1/2002

(Continued)

OTHER PUBLICATIONS

International Search Report dated Feb. 10, 2016, for PCT/EP2015/076312.

(Continued)

*Primary Examiner* — J. Todd Newton
(74) *Attorney, Agent, or Firm* — Beusse Wolter Sanks & Maire

(57) ABSTRACT

A steam turbine having an inflow ring channel which is connected to an inflow connecting piece in terms of flow technology. The inflow connecting piece is designed in such a way that an incoming flow is first slowed down, subsequently accelerated and simultaneously deflected.

6 Claims, 4 Drawing Sheets

(58) Field of Classification Search
USPC ..... 415/182.1
See application file for complete search history.

(56) References Cited

U.S. PATENT DOCUMENTS

| | | | | |
|---|---|---|---|---|
| 5,215,436 | A * | 6/1993 | Puzyrewski | F01D 1/023 415/182.1 |
| 5,601,405 | A * | 2/1997 | Coates | F01D 9/02 137/625.47 |
| 6,609,881 | B2 * | 8/2003 | Brown | F01D 9/045 415/102 |
| 8,702,376 | B2 * | 4/2014 | Mokulys | F01D 1/023 415/117 |
| 2002/0004003 | A1 * | 1/2002 | Aschenbruck | F01D 9/023 415/116 |
| 2003/0091431 | A1 * | 5/2003 | Brown | F01D 9/045 415/102 |
| 2007/0086890 | A1 | 4/2007 | OClair et al. | |
| 2008/0213085 | A1 | 9/2008 | Deidewig et al. | |
| 2010/0232958 | A1 | 9/2010 | Iwai et al. | |
| 2013/0115076 | A1 | 5/2013 | Bouchard et al. | |
| 2014/0271139 | A1 * | 9/2014 | Predmore | F01D 9/02 415/151 |

FOREIGN PATENT DOCUMENTS

| | | | |
|---|---|---|---|
| EP | 1312759 | A2 | 5/2003 |
| FR | 2295223 | A1 | 7/1976 |
| JP | 2007009820 | A | 1/2007 |
| JP | 2007113572 | A | 5/2007 |
| JP | 2010209857 | A | 9/2010 |
| JP | 2010216313 | A | 9/2010 |
| JP | 2012122407 | A | 6/2012 |
| RU | 2351766 | C2 | 4/2009 |
| RU | 2011153235 | A | 6/2013 |
| RU | 164736 | U1 | 9/2016 |
| WO | 2011104596 | A2 | 9/2011 |

OTHER PUBLICATIONS

EP Search Report dated Jun. 29, 2015, for EP patent application No. 14194077.5.

RU search report dated May 16, 2018, for RU patent application No. 2017121233.

* cited by examiner

INFLOW CONTOUR FOR A SINGLE-SHAFT ARRANGEMENT

CROSS REFERENCE TO RELATED APPLICATIONS

This application is the U.S. National Stage of International Application No. PCT/EP2015/076312 filed Nov. 11, 2015, and claims the benefit thereof. The International Application claims the benefit of European Application No. EP14194077 filed Nov. 20, 2014. All of the applications are incorporated by reference herein in their entirety.

FIELD OF INVENTION

The invention relates to a turbomachine, comprising a rotor mounted rotatably about an axis of rotation, a housing arranged about the rotor, and a flow duct formed between the rotor and the housing, further comprising an inflow region, which has an inflow connecting piece and issues into an annular inflow duct, wherein the annular inflow duct substantially has an annular duct cross section and is connected fluidically to the flow duct, wherein the annular inflow duct is formed about the axis of rotation, wherein the inflow connecting piece has an inflow cross section, through which a flow medium flows in a flow direction during operation.

The invention furthermore relates to a method for connecting an inflow connecting piece to an annular inflow duct.

BACKGROUND OF INVENTION

Steam turbines substantially comprise a rotor, which is mounted rotatably about an axis of rotation and comprises rotor blades, and also a housing formed with guide vanes, wherein a flow duct is formed between the rotor and the housing and comprises the guide vanes and rotor blades. Thermal energy of the steam is converted into mechanical energy of the rotor. Various partial turbines are known, these being divided, for example, into high-pressure, intermediate-pres sure and/or low-pressure partial turbines. The division of the partial turbines into a high-pressure, intermediate-pressure and low-pressure part is not uniformly defined among experts. The division depends in any case necessarily on the pressure and the temperature of the inflowing and outflowing steam.

Furthermore, embodiments in which a high-pressure part and an intermediate-pressure part are arranged in a common outer housing are known. Embodiments of this type require two inflow regions arranged tightly next to one another. In this case, it is necessary for rotor-dynamic aspects for the high-pressure inflow and intermediate-pressure inflow to lie tightly against one another, since the axial space is limited. Furthermore, it is more cost-effective if the high-pres sure inflow region and the intermediate-pressure inflow region are arranged tightly next to one another.

Furthermore, it is known to feed the steam to the flow duct via valves. In this case, steam flows through a fast-acting shut-off valve and a control valve and subsequently into an inflow region, and from there into an annular duct. The annular duct has a substantially rotationally symmetrical form about the axis of rotation. The velocities of the steam in the annular duct should be as uniform and low as possible. In the case of two-valve arrangements, i.e. steam flows via two valves and therefore via two inflow regions into the inflow duct, the flow conditions in the annular duct are different to those in the case of one-valve arrangements. In the case of one-valve arrangements, the steam flows via merely one inflow region into the annular duct. The cross section of the annular duct in the case of one-valve arrangements is generally greater than the cross section of the annular duct in the case of a two-valve arrangement. This is effected substantially so that the flow velocities are kept at a low level.

It would be possible to increase the size of the annular duct in the radial direction, but this increases stresses driven by internal pressure in the inner housing. On the other hand, an increase in the wall thickness would lead to stress reduction, which in turn would lead to an increase in the temperature-driven stresses. These two design concepts need to be optimized.

SUMMARY OF INVENTION

It is an object of the invention to specify an inflow region which leads to improved flow conditions.

This object is achieved by a steam turbine, comprising a rotor mounted rotatably about an axis of rotation, a housing arranged about the rotor, and a flow duct formed between the rotor and the housing, further comprising an inflow region, which has an inflow connecting piece and issues into an annular inflow duct, wherein the annular inflow duct substantially has an annular duct cross section and is connected fluidically to the flow duct, wherein the annular inflow duct is formed about the axis of rotation, wherein the inflow connecting piece has an inflow cross section, through which a flow medium flows in a flow direction during operation, wherein the cross section increases to a maximum cross section in the flow direction and subsequently reduces to the annular duct cross section.

The invention therefore pursues the approach of modifying the flow velocities in the inflow region, this being effected by a change in geometry of the inflow region. In this case, substantially the connection of the cross section between the inflow connecting piece and the annular duct is modified, wherein the cross section is increased beyond the annular duct cross section, and, after the flow has been decelerated, renewed acceleration is achieved, albeit in a different direction.

The dependent claims specify advantageous developments. Thus, in one advantageous development, the ratio between maximum cross section A2 and inflow cross section A1 is as follows: $1.1<A2/A1<1.7$.

By virtue of optimization tests and flow models, it was possible to determine that the aforementioned relationship leads to an optimum flow.

Furthermore, in one advantageous development, the following relationships are represented: $0.7<A3/A3<1.0$, where A3 denotes the annular duct cross section.

Here, too, an optimum inflow with the aforementioned values was determined by models and calculations.

The above-described properties, features and advantages of this invention and also the manner in which they are achieved will become clearer and more easily comprehensible in conjunction with the following description of the exemplary embodiments, which will be explained in more detail in conjunction with the drawings.

Exemplary embodiments of the invention will be described hereinbelow with reference to the drawings. Said drawings are not intended to illustrate the exemplary embodiments in a representative manner, but rather the drawing, where expedient for elucidations, is shown in schematic and/or slightly distorted form. With respect to additions to the teaching directly identifiable in the drawing, reference is made to the relevant prior art.

DETAILED DESCRIPTION OF INVENTION

Figure 1:
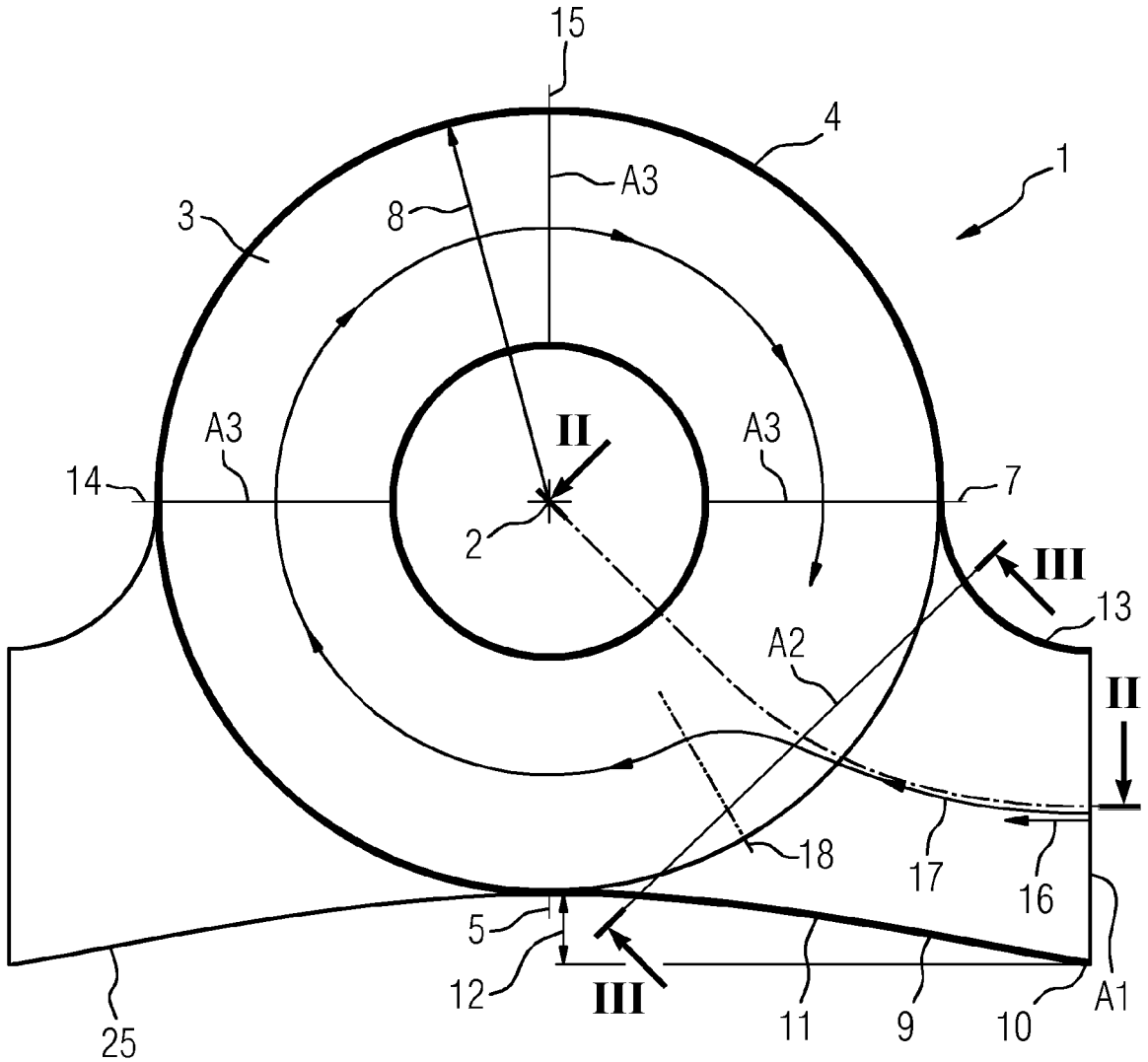
FIG. 1 shows a schematic cross-sectional view of an inflow region.

FIG. 1 shows a cross-sectional view of an inflow region 1 of a steam turbine. The steam turbine is not shown in greater detail in FIG. 1. The steam turbine substantially comprises a rotatably mounted rotor, which is mounted rotatably about an axis of rotation 2. A housing, for example an inner housing, is arranged about the rotor.

A further housing, for example an outer housing, can be arranged about the inner housing. A flow duct (not shown) is formed between the rotor and the housing. The rotor comprises a plurality of rotor blades on its surface. The inner housing has a plurality of guide vanes on its inner surface. The flow duct is therefore formed by the guide vanes and rotor blades, with thermal energy of the steam being converted into rotational energy of the rotor during operation. FIG. 1 now shows the inflow region of a steam turbine, the flow duct being directed in the direction of the axis of rotation. The inflow region 1 comprises an annular inflow duct 3. The latter has a substantially rotationally symmetrical form in relation to the axis of rotation 2 and has an outer delimitation 4. This outer delimitation 4 has a rotationally symmetrical form at least from the 6 o'clock position 5 to the 3 o'clock position 7. This means that a housing radius 8 is constant from the 6 o'clock position 6 to the 3 o'clock position 7.

The inflow region furthermore has an inflow connecting piece 9. The inflow connecting piece 9 is substantially a tubular connection which connects a steam line (not shown) to the annular inflow duct 3. The inflow connecting piece 9 has an individual geometrical shape. This shape will now be described in more detail. The initial contour 10 forms the connection to a tubular steam line (not shown). The cross section of the initial contour 10 may therefore be circular. Other geometrical tubular contours are also possible, however. This initial contour 10 comprises a lower connecting piece delimitation 11, which is formed in such a manner as to adjoin in the 6 o'clock position 5. That is to say that the lower connecting piece delimitation 11 is directed tangentially with respect to the axis of rotation 2 to the outer delimitation 4. In this case, the lower connecting piece delimitation 11 can by all means be arranged in such a way that, in the vicinity of the initial contour 10, it is arranged below the outer delimitation 4 at the 6 o'clock position 5. The lower connecting piece delimitation 11 at the initial contour 10 is therefore lower by a height distance 12 than the outer delimitation 4 in the 6 o'clock position 5.

The inflow connecting piece 9 furthermore comprises an upper connecting piece delimitation 13. The upper connecting piece delimitation 13 begins from the initial contour 10 and describes a semicircular arc upward to the 3 o'clock position 7. The upper connecting piece delimitation 13 adjoins the 3 o'clock position 7 tangentially to the outer delimitation 4. The inflow connecting piece 9 therefore issues into the annular inflow duct 3. The annular inflow duct 3 substantially has an annular duct cross section A3 (not shown in greater detail) and is connected fluidically to the flow duct (not shown). For reasons of clarity, FIG. 1 shows the annular duct cross section A3 in the 9 o'clock position 14, in the 12 o'clock position 15 and in the 3 o'clock position 7.

At the initial contour 10, the inflow connecting piece 9 has an inflow cross section A1. The inflow cross section A1 can have a circular or else an oval shape. During operation, a flow medium, in particular steam, flows through the steam turbine in a flow direction 16 into the annular inflow duct 3. The flow of the steam into the annular inflow duct is complex and will be described in more detail hereinbelow in FIG. 6 and FIG. 7. For understanding the contour shown in FIG. 1, the flow is represented by a flow line 17 for the sake of clarity. The flow line 17 is intended substantially to illustrate the movement of the flow medium in the annular inflow duct. The flow thus begins at the initial contour 10 and is deflected in the initial direction approximately in the 5 o'clock position 18. Along the flow line 17, the inflow cross section A1 has a specific value and increases to a maximum cross section A2. The maximum cross section is denoted by a line in FIG. 1, the line also illustrating a section III-III, which will be described in more detail in FIGS. 3, 4 and 5. According to the invention, the cross section in the flow direction 16 is therefore reduced to an inflow cross section A1 and subsequently to the annular duct cross section A3. This has the effect that the flow is decelerated and is accelerated again, albeit in a different direction. In other words: the flow velocity is decelerated in the course of the cross-sectional inlet to the access into the annular duct and subsequently accelerated again, with a proportion of the velocity in the tangential direction being converted into a velocity component in the radial direction. This radial flow velocity component obstructs the path of the circumferential tangential flow and thus presses the steam axially into the flow duct. Inflow losses are minimized as a result.

In this respect, the following holds true: $1.1<A2/A1<1.7$ and $0.7<A3/A1<1.0$.

Figure 2:
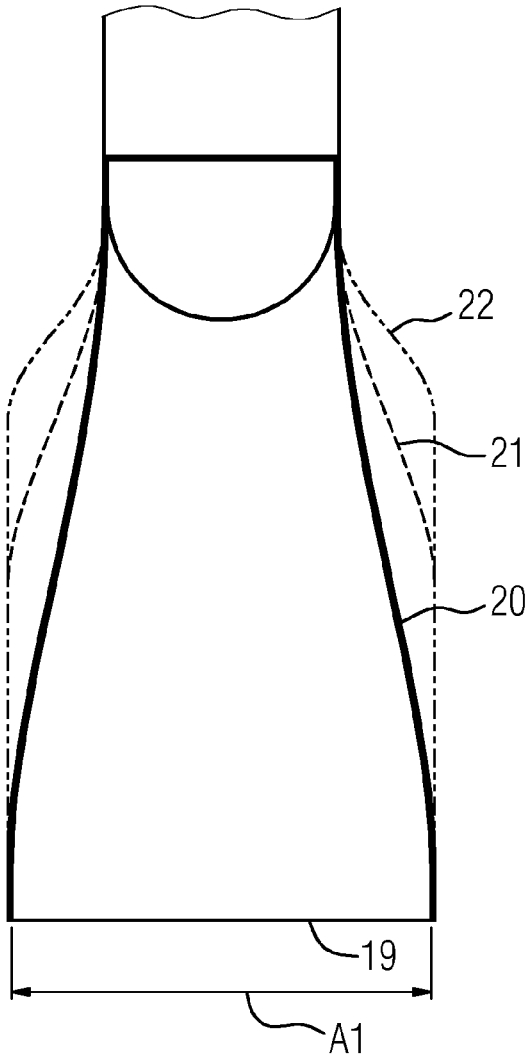
FIG. 2 shows a section II-II from FIG. 1.

FIG. 2 shows a sectional illustration along the line II-II from FIG. 1. In this figure, the line 19 shows the inflow cross section A1 and the lines 20, 21 and 22 show three different embodiments, which can be described as follows. The line 20 describes a contour at which the ratio A2/A1=1. The line 21 describes a contour at which the ratio A2/A1=1.25. The line 22 describes a contour at which the ratio A2/A1=1.55.

Figure 3:
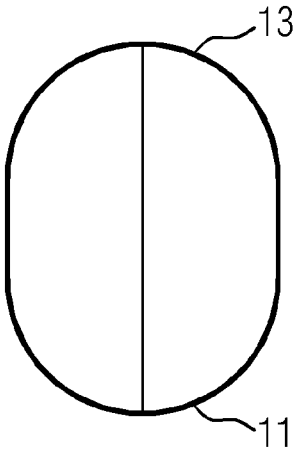
FIG. 3 shows a section III-III from FIG. 1.
Figure 4:
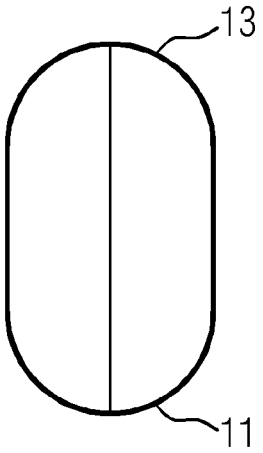
FIG. 4 shows a section III-III from FIG. 1 in an alternative embodiment.
Figure 5:
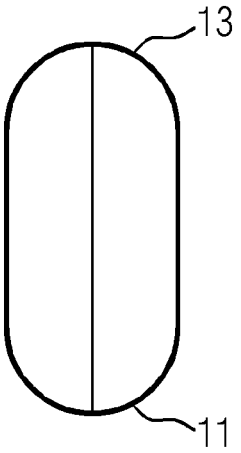
FIG. 5 shows a section III-III from FIG. 1 in an alternative embodiment.

FIG. 3 shows a section along the line III-III from FIG. 1. FIGS. 4 and 5 show further cross sections along the interface III-III from FIG. 1 for different ratios. Thus, FIG. 3 shows the ratio A2/A1=1.55. FIG. 4 shows the ratio A2/A1=1.25 and FIG. 5 shows the ratio A2/A1=1.

Figure 6:
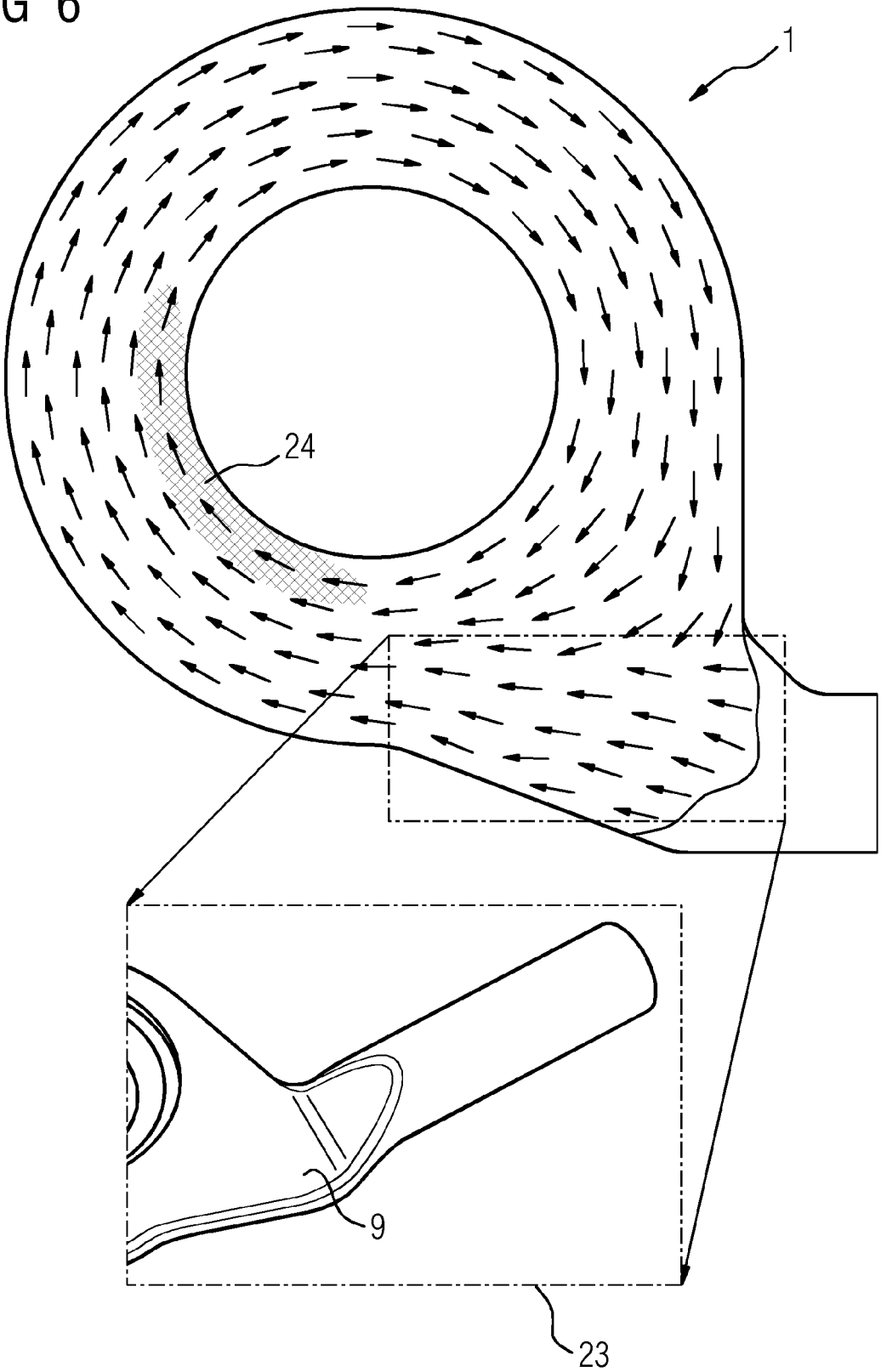
FIG. 6 shows a schematic illustration of the flow conditions according to the prior art.
Figure 7:
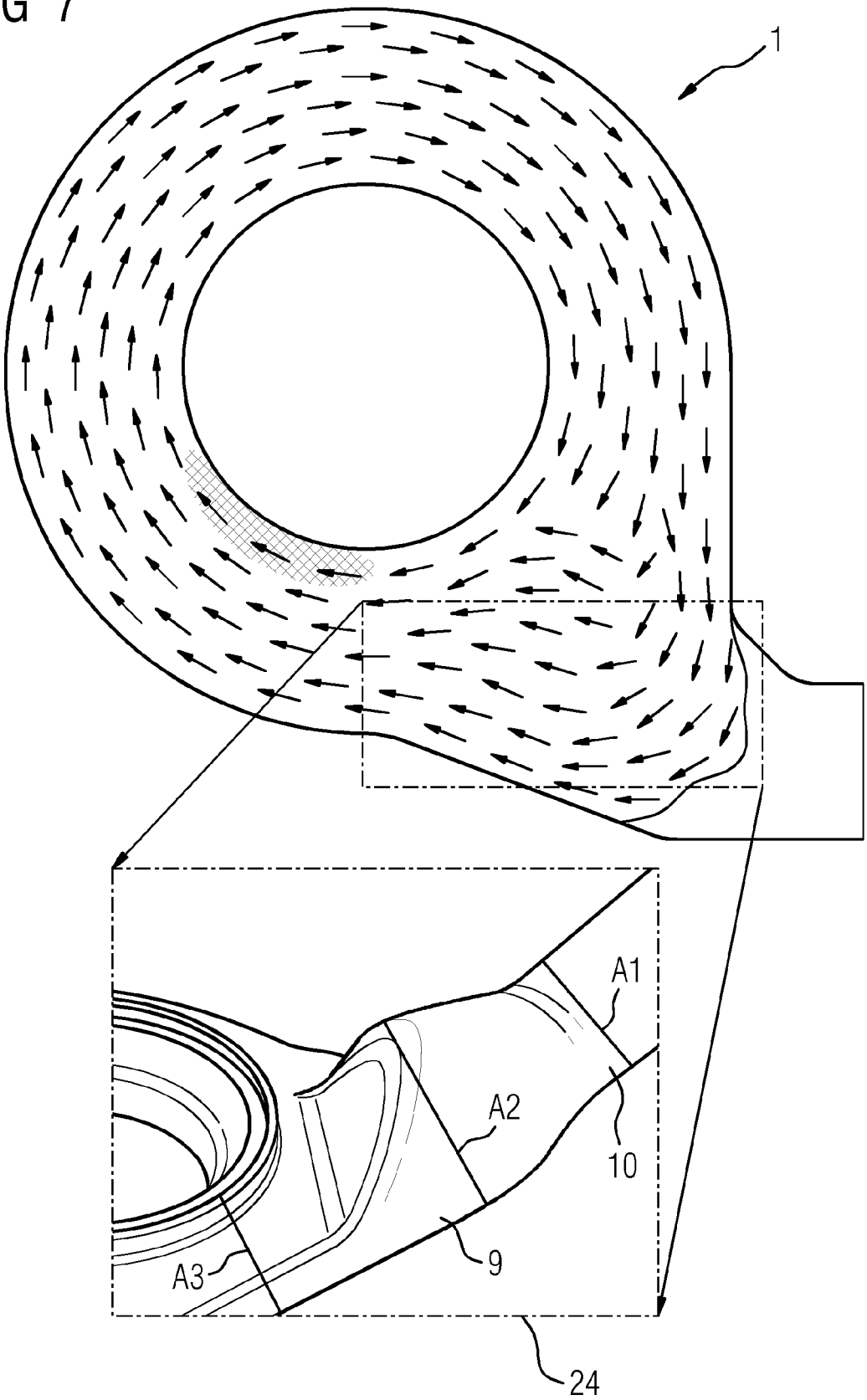
FIG. 7 shows a schematic illustration of the flow conditions according to the invention.

FIG. 6 shows a schematic illustration of the flow conditions in the inflow region 1 in the case of a flow affected by losses. The excerpt 23 shows a perspective illustration of the inflow connecting piece of the inflow region 1. FIG. 6 in this respect shows an embodiment in which the cross section is not increased in the flow direction. FIG. 6 moreover shows that the flow in the inflow region has a strong circumferential component in a critical region 24. FIG. 7, by contrast, shows an embodiment according to the invention of the inflow connecting piece 9. The further section 24 shows a perspective illustration of the inflow connecting piece 9 of the inflow region 1. It can be seen that the cross section A1 at an initial contour 10 is increased in the flow direction to a maximum cross section A2 and is subsequently reduced to a constant annular duct cross section A3. The embodiment shown in FIG. 1 shows a one-valve arrangement. For reasons of clarity, the contour of a possible second valve guide 25 has been shown.

Although the invention has been illustrated and described in more detail by the preferred exemplary embodiment, the invention is not limited by the disclosed examples, and other variations can be derived therefrom by a person skilled in the art without departing from the scope of protection of the invention.

The invention claimed is:

1. A steam turbine, comprising a rotor mounted rotatably about an axis of rotation, a housing arranged about the rotor, and a flow duct formed between the rotor and the housing, an inflow region, which comprises an inflow connecting piece and issues into an annular inflow duct, wherein the annular inflow duct substantially comprises an annular duct cross section and is connected fluidically to the flow duct, wherein the annular inflow duct is formed about the axis of rotation, wherein the inflow connecting piece comprises an inflow cross section A1, through which a flow medium flows in a flow direction during operation, wherein an inflow cross section increases to a maximum cross section A2 in the flow direction and subsequently reduces to an annular inflow duct cross section A3, and wherein the following holds true: $1.1<A2/A1<1.7$.

2. The steam turbine as claimed in claim 1, wherein the annular inflow duct substantially comprises a rotationally symmetrical form about the axis of rotation.

3. The steam turbine as claimed in claim 1, wherein the flow direction is formed substantially tangentially to the annular inflow duct in a region of the inflow connecting piece.

4. The steam turbine as claimed in claim 1, wherein the following holds true:

$$0.7<A3/A1>1.0.$$

5. The steam turbine of claim 1, wherein the inflow connecting piece is the sole inflow connecting piece that issues into the annular inflow duct.

6. A method for optimizing flow conditions in an inflow region of a steam turbine, wherein the steam turbine comprises a rotor mounted rotatably about an axis of rotation, a housing arranged about the rotor, and a flow duct formed between the rotor and the housing, and further comprises the inflow region, which comprises an inflow connecting piece and issues into an annular inflow duct, wherein the annular inflow duct substantially comprises an annular inflow duct cross section A3 and is connected fluidically to the flow duct, wherein the inflow connecting piece comprises an inflow cross section A1, through which a flow medium flows in a flow direction during operation, the method comprising:

increasing an inflow cross section to a maximum cross section A2 in the flow direction, and subsequently reducing the inflow cross section to the annular inflow duct cross section A3, wherein the following holds true: $1.1<A2/A1<1.7$.

* * * * *